US006029655A

United States Patent [19]

Hussong et al.

[11] Patent Number: 6,029,655

[45] Date of Patent: Feb. 29, 2000

[54] MODULAR GAS FIREPLACE INSERT

[75] Inventors: Dudley D. Hussong, Lakefield, Minn.; David S. Reimers, Lake Park, Iowa

[73] Assignee: Hussong Manufacturing Co., Inc., Lakefield, Minn.

[21] Appl. No.: 09/097,422

[22] Filed: Jun. 15, 1998

Related U.S. Application Data

[60] Provisional application No. 60/083,134, Apr. 27, 1998.

[51] Int. Cl.[7] ..... F24B 1/185

[52] U.S. Cl. ..... 126/515; 126/531; 126/85 B; 126/312

[58] Field of Search ..... 126/77, 80, 85 B, 126/312, 317, 515, 516, 524, 525, 527, 512, 531

[56] References Cited

U.S. PATENT DOCUMENTS

| | | | |
|---|---|---|---|
| 4,736,730 | 4/1988 | Robertson | 126/123 |
| 4,909,227 | 3/1990 | Rieger | 126/531 |
| 4,964,396 | 10/1990 | Crum | 126/515 |
| 5,092,313 | 3/1992 | Blackburn et al. | 126/512 |
| 5,267,552 | 12/1993 | Squires et al. | 126/512 |
| 5,307,801 | 5/1994 | Schroeter et al. | 126/515 |
| 5,320,086 | 6/1994 | Beal et al. | 126/512 |
| 5,452,708 | 9/1995 | Shimek et al. | 126/512 |
| 5,542,407 | 8/1996 | Hawkinson | 126/77 |
| 5,590,641 | 1/1997 | Duong | 126/85 B |
| 5,647,340 | 7/1997 | Shimek et al. | 126/85 B |
| 5,647,342 | 7/1997 | Jamieson et al. | 126/512 |
| 5,931,154 | 8/1999 | Hussong et al. | 126/512 |

FOREIGN PATENT DOCUMENTS

| | | | |
|---|---|---|---|
| 1281249 | 3/1991 | Canada . | |
| 0446136 | 9/1991 | European Pat. Off. | 126/312 |

*Primary Examiner*—Ira S. Lazarus
*Assistant Examiner*—Sara Clarke
*Attorney, Agent, or Firm*—Westman, Champlin & Kelly, P.A.

[57] ABSTRACT

A gas fireplace insert for inserting into existing solid fuel fireplaces is made into modules that are separable for installation and can be later assembled together. A housing module which includes a combustion chamber supports a separable module comprising a duct for fresh air intake. The duct includes a connection collar for an air intake pipe leading to the interior of the duct. The duct also has a pass through collar for carrying exhaust gases from the fireplace. The collars can be attached to an exhaust pipe and air intake pipe respective, which extend through the existing chimney. The duct module is separated from the housing module for installation so that the pipe connections are easier to make with the lighter, smaller module. Once the pipes are connected to the respective collars, the gas fireplace housing module is inserted into the existing fireplace opening and the air intake duct module is attached to the fireplace housing with openings in the housing aligning with and can be sealed relative to the exhaust pipe connection collar and with the opening in the air intake duct.

12 Claims, 7 Drawing Sheets

MODULAR GAS FIREPLACE INSERT

CROSS REFERENCE TO RELATED APPLICATION

This application claims priority on prior copending U.S. provisional application Ser. No. 60/083,134, filed Apr. 27, 1998.

BACKGROUND OF THE INVENTION

The present invention relates to a gas fireplace insert to convert an inefficient zero clearance solid fuel burning fireplace into an efficient gas burning fireplace utilizing the usually minimal space that is provided inside the existing fireplace for making needed flue connections.

Many solid fuel burning fireplaces now in existence are inefficient and do not provide a fresh combustion air intake. Conversion to a gas burning fireplace is desired in many instances, because of the more efficient use, clean burning and the possibility of having external fresh air for combustion. Many wood burning fireplaces have internal linings of brick or the like, with generally at least an 8 inch existing chimney that can be made in various ways, including a round tube that is provided with exterior concentric tubes for insulating the hot flue gas carrying metal tube. Usually these are an 8 inch I.D. tube, and that space is used, with the present invention for providing an easy way for inserting and assembling a gas fireplace insert having an exterior combustion air supply tube.

While existing log or solid fuel burning fireplaces are relatively inefficient, a gas fireplace insert converts this space into a very efficient burning system, particularly when a fresh air intake is provided.

Flue liners and adapters for flue liners have been advanced, as shown in U.S. Pat. No. 5,590,641, but the ability to install them with a simplified method is not suggested. Likewise, it is well known to have fresh air intakes for fireplaces, such as that shown in U.S. Pat. No. 5,647,342. This invention provides a way of using a modular gas fireplace insert for simplification of the installation in existing fireplace openings.

SUMMARY OF THE INVENTION

The present invention provides a modular gas fireplace insert which can be easily installed into an existing wood or other solid fuel burning fireplace using the existing chimneys or flues. The installation provides a fresh combustion air intake tube which is separated from the exhaust flue used for carrying exhaust gases and fresh air. The gas fireplace insert has a removable, relatively small and light weight module forming duct that carries fresh air to the burner and provides a through passage for exhaust gases. The duct is easily maneuverable so that it makes the installation of the pipes much more simple.

The modular system can be used either with concentric fresh air intake and exhaust pipes, or side by side pipes that will fit into larger flues. With suitable sealing and gasketing, the installation is readily made, and provides for a highly efficient gas fireplace unit installed in existing fireplace housings.

DETAILED DESCRIPTION OF THE PREFERRED EMBODIMENTS

Figure 1:
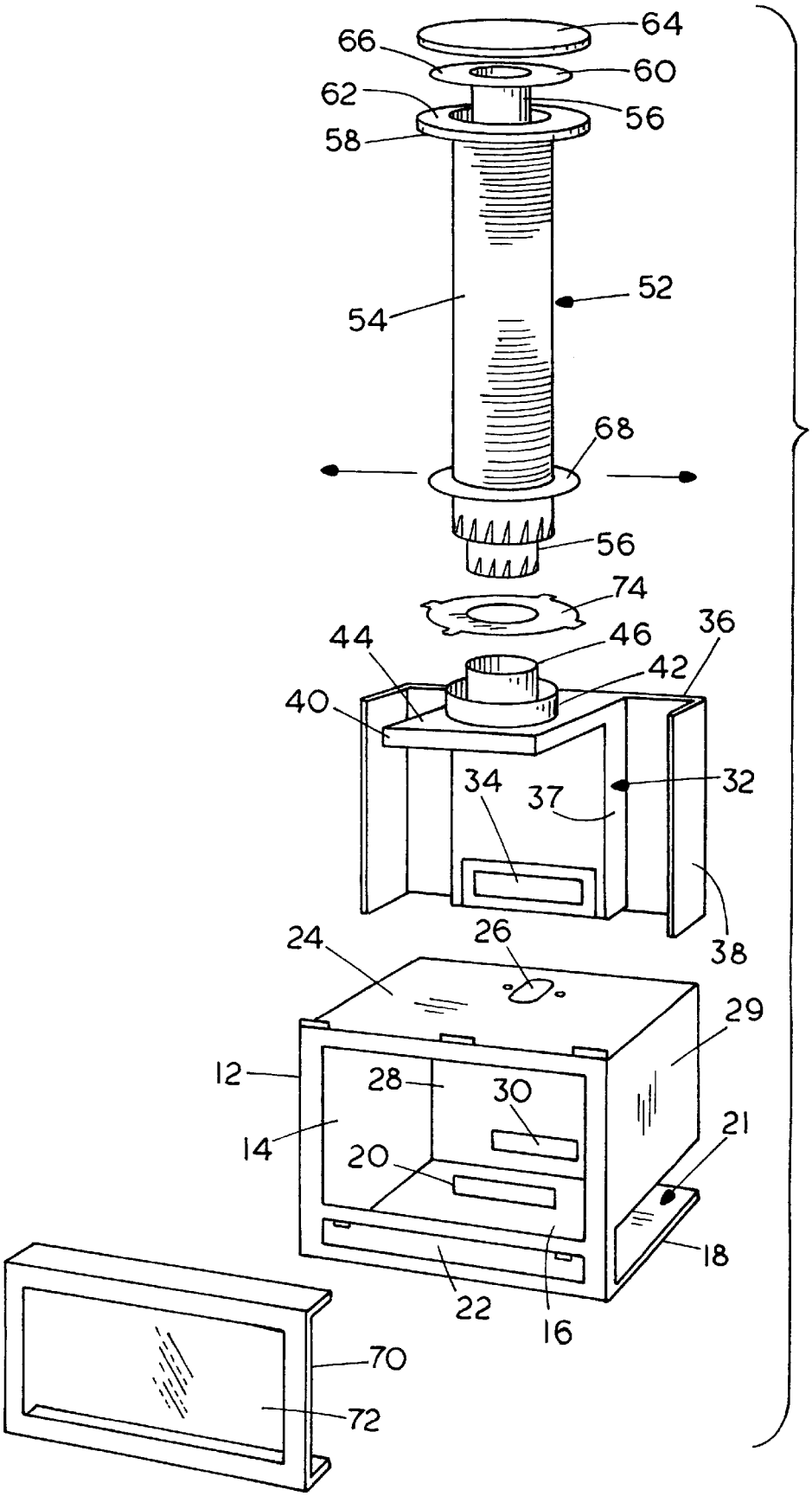
FIG. 1 is a schematic exploded view of a modular gas fireplace insert made according to the present invention.

FIG. 1 shows an exploded view of a modular gas insert fireplace that can be used for installation into an existing zero clearance solid fuel or masonry fireplace. The existing chimney is used, as will be shown, and the existing fireplace housing can be of any desired form, as long as it has suitable interior dimensions. Certain minimum clearances from the room air outlet grill from any combustible mantle and the like have to be observed as well.

The gas fireplace insert of the present invention goes into an existing fireplace housing or opening, and comprises a modular gas fireplace housing 12 that has an interior burner or combustion chamber 14. The chamber 14 is defined by a floor 16 for supporting a burner shown at 20 in FIG. 2. The floor 16 is raised above a housing base plate 18 to form a room air intake duct 21, as will be seen, for drawing air in through a front port 22 and as will be explained delivering this air through a heat exchange chamber around the exterior of the burner chamber. The upper or top wall 24 of the fireplace housing has a generally oval shaped exhaust gas outlet opening 26. The rear wall 28 of the housing has a port or air inlet opening 30 forming a fresh combustion air intake. The intake air duct module 32 is shown above the housing in FIG. 1. Duct 32 is a rectangular cross section shape tubular member formed in an L shape and having a fresh air outlet port 34 that mates with the port or opening 30 in the rear wall of the housing 12 to provide fresh air to the combustion chamber 14.

The module 32 carries, as shown, a sheet metal shroud 36 that has side panels 38 that are used for cooperating with the side walls 29 of the housing 12 to form the heat exchange chambers and for providing, in combination with the existing fireplace walls, passageways for air to be taken in from the room and discharged out of the room after heating.

The L shaped duct 32 includes a vertical duct section 37, that is rectangular in cross section, and a horizontal or top duct section 40 which is rectangular in cross section and overlies the top wall 24 of the fireplace housing 12 when the module 32 is assembled in position on the housing 12. As will be shown, a connector ring or collar 42 is welded in the top duct section 40 and extends above the top wall 44 of duct section 48 for intake air pipe connection. The ring 42 is a large diameter tube section that is connected to an opening in the top wall 44 of the horizontal duct section 40. Concentric with and spaced from the connection ring 42 is a flue or exhaust pipe connector 46.

Figure 8:
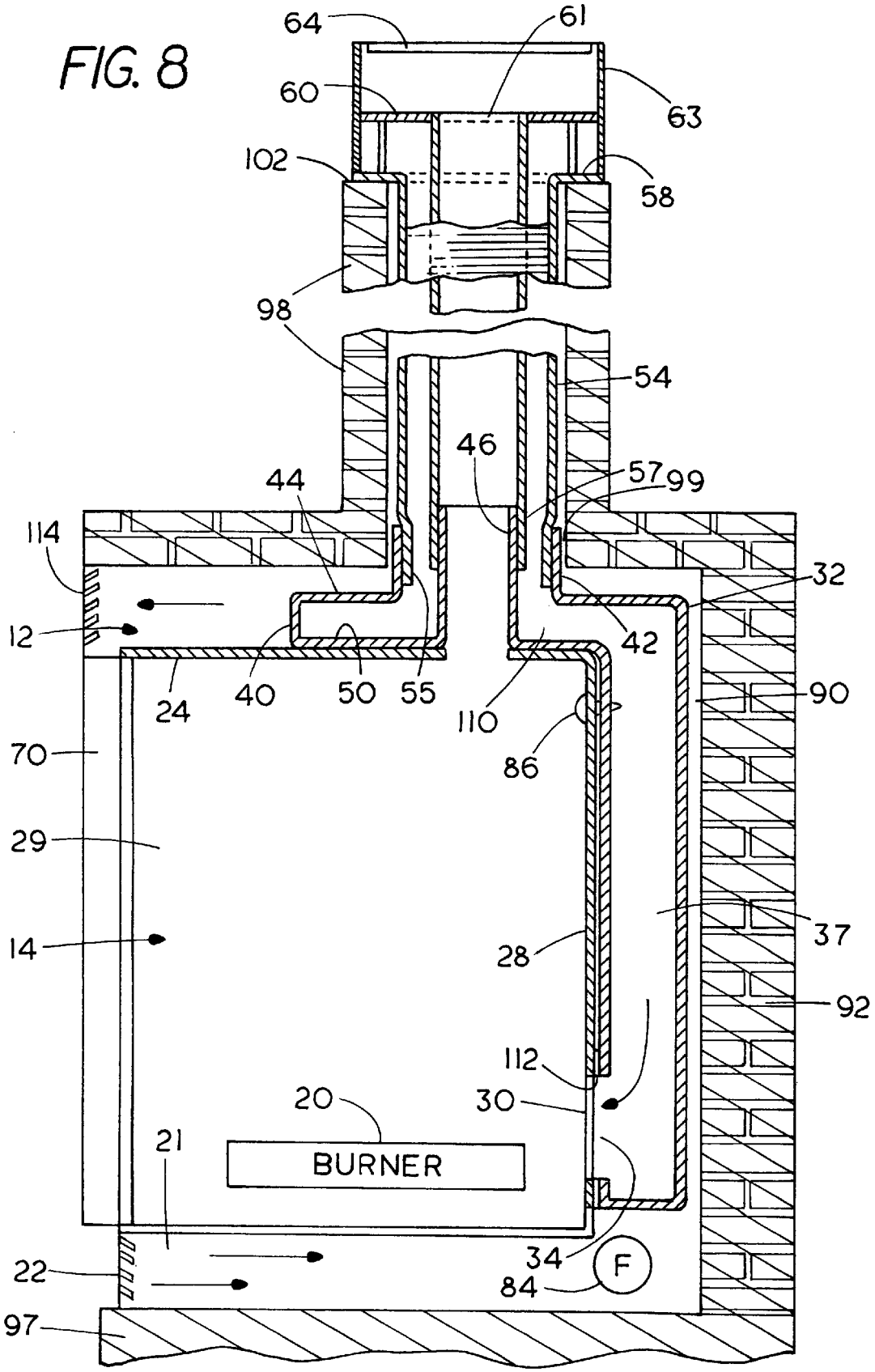
FIG. 8 is a schematic sectional view of a gas burning fireplace made according to the present invention installed in an existing fireplace housing.

Flue pipe connector 46, as will be seen, particularly in FIG. 8, is sealed relative to a bottom wall 50 of the horizontal duct section 40, and extends upwardly higher than the top of the inlet or intake air connector 42.

A flexible air intake pipe and exhaust flue pipe assembly indicated at 52 is made with an outer air intake pipe or tube 54 that has an end that telescopes onto and sealingly mates with the collar 42, and which will carry intake air from the exterior through the space around the inner exhaust or tube flue pipe 56, which is smaller diameter and is concentric with and centered on the tube 54. Both of these pipes or tubes are, as stated, flexible pipe that can be extended in length from a compressed length and can be manipulated side to side by bending them. Such flue pipes are well known in the art, and can be made of stainless steel or other suitable material that will withstand the heat involved in a gas fireplace outlet flue.

Figure 5:
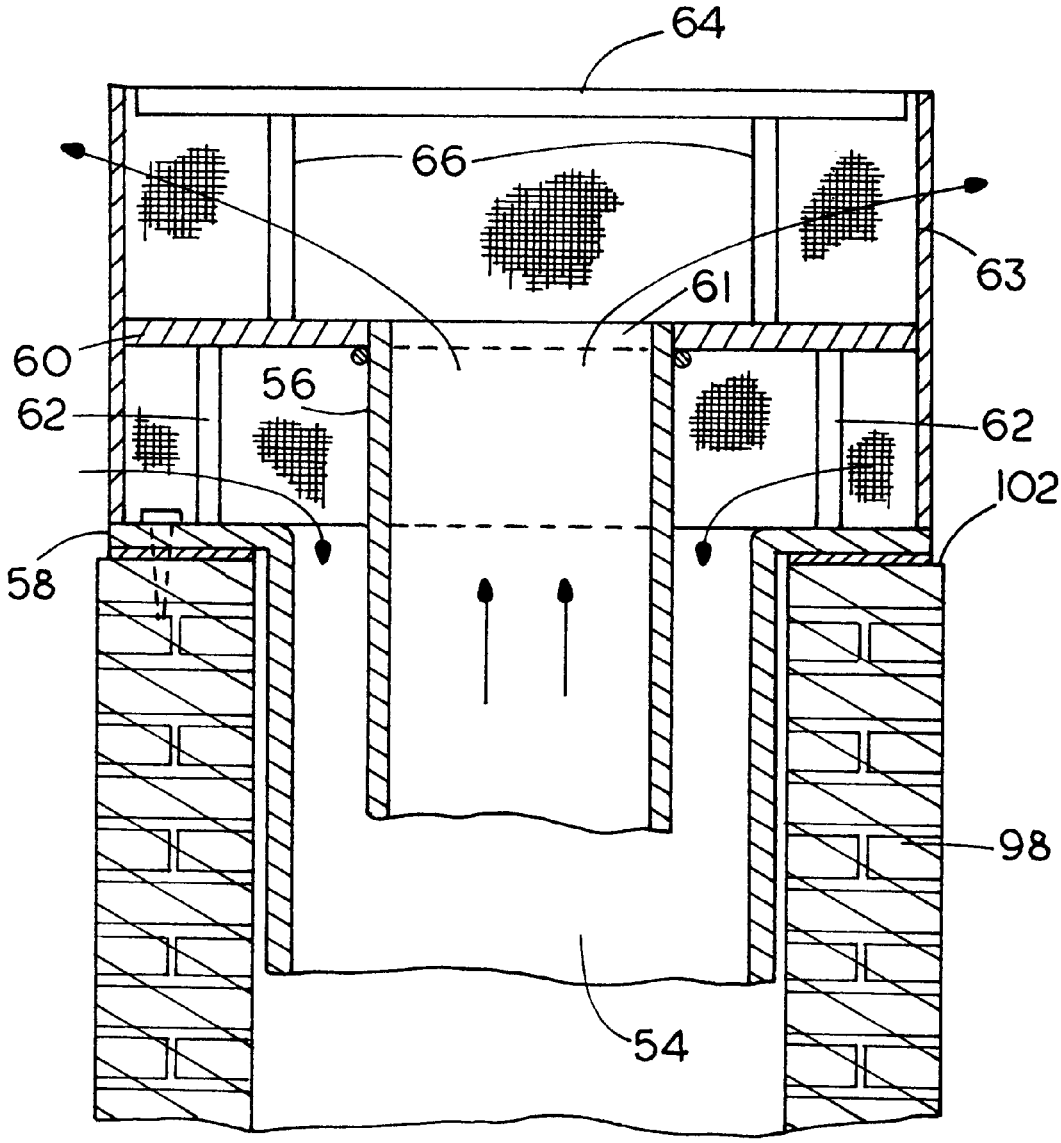
FIG. 5 is an enlarged part schematic view of the top end of an existing flue into which the exhaust pipe and fresh air intake pipe of the present invention are installed.

As shown in FIG. 5 and FIG. 1, the outer pipe 54 for fresh air intake has an intake air termination flange 58 at the upper end thereof, that is fixed to the outer pipe, and is made of size to rest on an upper edge 102 on an existing flue or chimney 98. The exhaust gas flue pipe 56 has a termination ring 60 fixed thereto. The ring 60 is supported above the ring 58 through suitable spaced apart support legs 62. The ring 60 supports a cap 64 that is a solid wall cap on suitable legs 66.

FIG. 1 shows a ring of insulation 68 that can be used between the existing chimney or flue and the outer pipe 54 to stop drafts and the like from entering the room through the existing chimney. Additionally, a front wall 70 having a glass door insert 72 can be placed over the front opening of the combustion chamber of the fireplace housing in a normal manner.

The parts that are shown can also include a stop ring 74 that can be used for centering or retaining the pipe 54 in the existing chimney.

Figure 2:
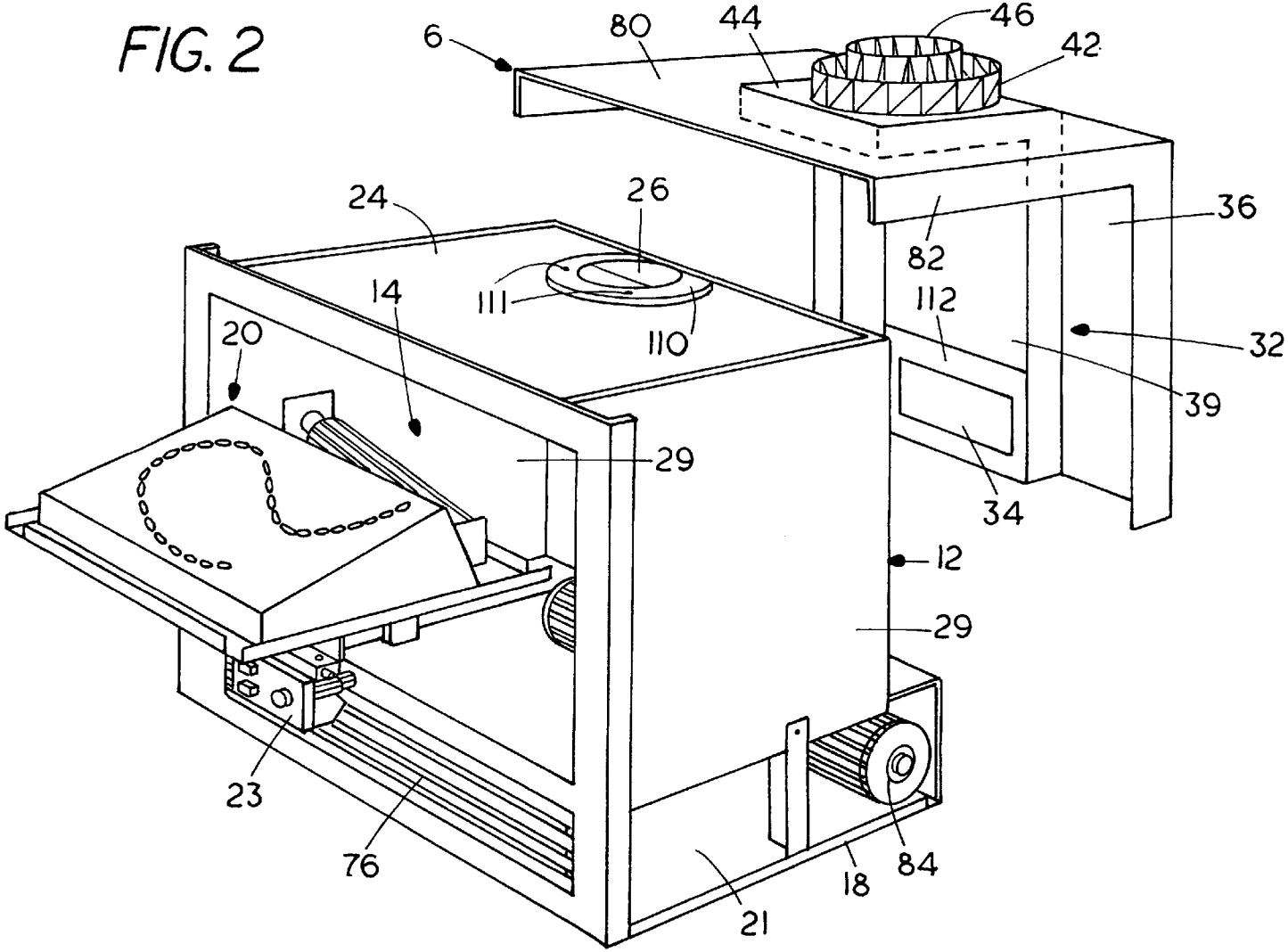
FIG. 2 is an enlarged perspective view of the two main modules of the gas fireplace insert of the present invention.

FIG. 2 shows that there is a grating 76 placed over the inlet opening 22 leading to the room air inlet duct 21 formed by the floor 18 and the bottom wall 16 of the burner housing. The burner 20 is also shown, and it is of any type that is desired for this unit, but it can be any type suitable for a gas fireplace. Suitable controls 23 are provided for controlling gas from a source (not shown) to the burner.

The back panel 36 and side panels 38 carried by the fresh air module 32 also are connected to a top heated air duct formed by wall 80 (FIG. 2) that has depending side flanges 82 and which will fit around the housing 12 for the gas fireplace insert to form a passageway for heated air to be discharged out through the front of the unit into the space or room to be heated.

A fan or blower 84 is located in the duct formed by the bottom wall 18 and the back wall 36 and top wall 80, for drawing air through the grate 76 and discharging it through the heat exchange chambers back into the room when the fireplace insert is working.

The gas fireplace insert can be shipped to the installation site fully assembled with the front panel 70 in place, as well as the module 32 held onto the outer housing. The modular unit will be disassembled for installation, taking the module 32 off the housing, and taking the front panel out as well, and also disassembling the burner from its installed position. This is to provide a lighter weight for the module until that has to be manipulated for installation.

Figure 3:
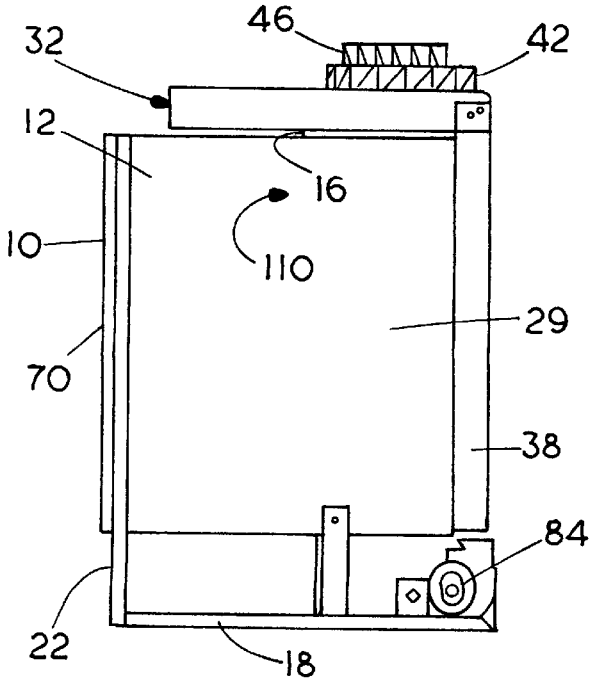
FIG. 3 is a side view of the gas fireplace insert, showing a fresh air duct module installed for providing fresh air intake and exhaust pipe connections mounted thereon outside of the existing fireplace opening in which the insert is to be installed.

FIG. 3 shows a side view of the gas fireplace insert as it would appear when they are received at the installation site. The intake air duct module 32 would be removed by removing suitable screws that hold the module in place. For example, in FIG. 8, the screws are shown at 86.

Figure 4:
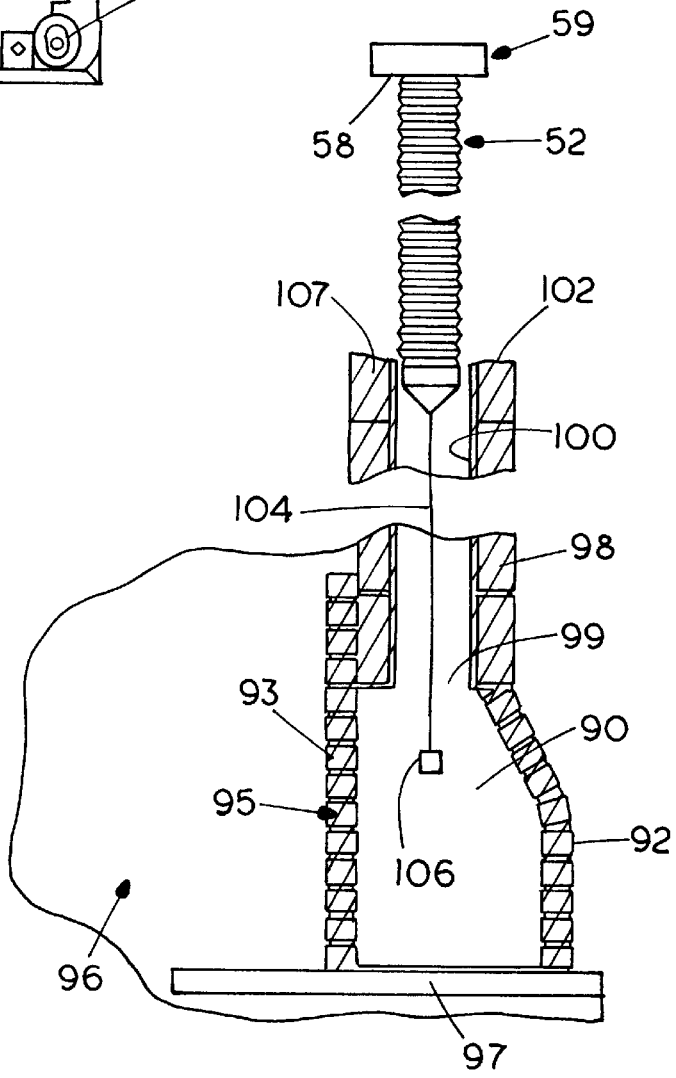
FIG. 4 is a schematic sectional view of a typical fireplace housing and existing flue showing schematically a step of installing the new exhaust pipe and fresh air intake assembly used with the modular unit of the present invention.

FIG. 4 shows one of the first steps in installing the gas fireplace into a typical existing fireplace. The pre-existing fireplace has a chamber 90, formed by brick walls 92 and 93 with a suitable opening 95 leading into the interior of a room 96. A base wall 97 is provided for the interior chamber 90, and in addition, a masonry or other type of chimney 98 would be leading from an inlet opening 99 out to the exterior above the roof. A metal flue liner can be provided as shown at 100 on the interior of the chimney 98. The flue liner usually would terminate flush with the masonry chimney above the roof, along a plane or edge shown at 102, or it will be trimmed to be flush with edge 102 before starting the installation.

The flexible pipe assembly 52 which includes the termination assembly 58 at the top, is taken to the roof and the flexible pipe or tubes are connected to a suitable rope 104 having a weight 106 that aids in pulling the flexible pipe assembly through the top opening 107 of the existing chimney. The flexible pipes 54 and 56 are pulled through the flue 100 by a person on the interior of the fireplace. One installer would have to be on the roof and the vent assembly or system 52 is dropped through. The size of the flexible pipes has to be less than the diameter of the flue liner 100. Even if there are offsets in the existing chimney, the weighted rope can be guided through the chimney and then used to pull the flexible pipes or tubes through. Separate ropes can be attached to the outer flexible tube or pipe 54 as well as the inner flexible tube or pipe 56.

The length of the chimney 98 is measured so that the vent assembly 52 including the fresh air intake pipe and the flue vent pipe will pass all the way through the liner. Extensions can be connected to increase the length if needed. Termination assembly 50 can include an outer screen 63 around the parts shown in FIG. 1, to keep out pests, and the flange 58 will rest upon the upper surface 102 of the chimney. A liberal bead of sealant is placed on the upper surface 102 of the chimney around the chimney opening, and the termination cap, including the flange 58 is rested on this surface. The flange 58 can be secured to the chimney with suitable self-drilling screws that will go into masonry or other material as used for the chimney. These screws are shown in FIG. 5.

FIG. 5 is a schematic showing of the top assembly in place. The flange 58 is resting on the upper edge 102. The sealant is indicated by a darker line around the surface 102 surrounding the chimney. The flange 58, as stated, support the termination ring 60 for the exhaust pipe on suitable supports or legs 62 so that fresh air can come in under the flue termination plate 60 and above the flange 58. The flue exhaust tube or pipe 56 is shown in FIG. 5 to provide an exhaust opening 61, in the plate. The exhaust tube or pipe 56 is sealed and secured to the plate 60. The cap 64 is for deflecting the exhaust gases. The outer screen 63 can be supported on the plate or cap 64 surrounding the chimney 98. The screen prevents birds or pests from coming into the flue, while permitting exhaust gases to escape and fresh air to enter.

Figure 6:
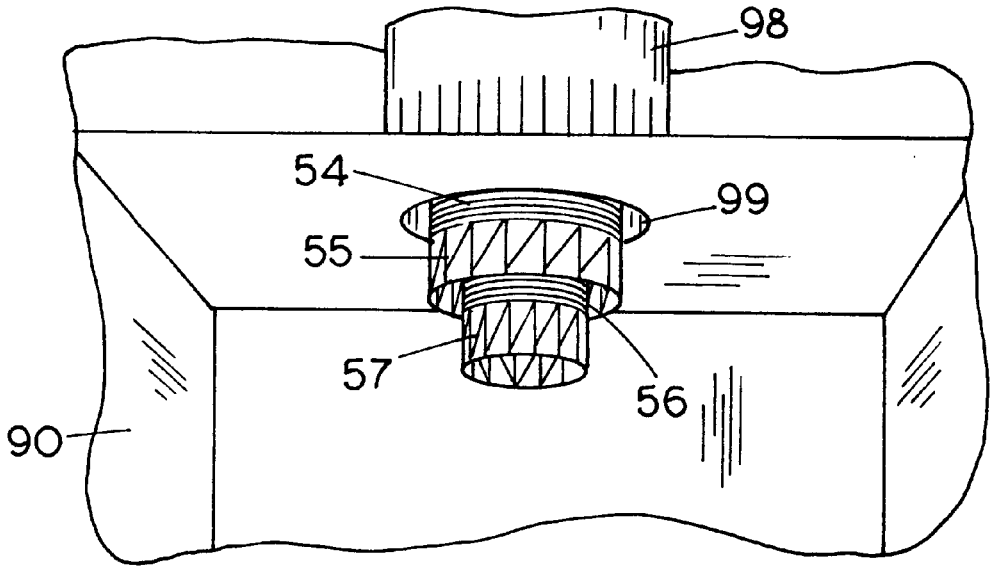
FIG. 6 is a fragmentary schematic perspective view of the interior of an existing fireplace chamber showing the existing flue opening having the pipes of the present invention protruding into the fireplace opening for installation.

The next step in the installation is in the existing fireplace chamber 90, as shown schematically in FIG. 6, where an upper wall provided with an opening 99 leading to the existing chimney 98.

The exhaust flue pipe 56 has a termination end slip fitter 57 that can be fitted onto end of the collar 52 in a normal manner, and the fresh air intake pipe 54 also has an end slip fitter 55 that can be slipped into the fresh air connector collar 46.

The ring of insulation shown at 68 in FIG. 1 would be stuffed into the opening 99 to surround the fresh air intake pipe 54. Suitable guides can be used for centering the pipes in the existing chimney, such as the collar 74. Insulation also can be added at the upper end of the chimney, to close any clearance between the pipe 54 and the interior bore of the existing chimney 98, to maintain an air seal as desired. The connector end 57 can have a standard snap connector (not shown) that is used for connecting to existing flue pipes. The end 57 will slip either into the exterior or interior of the collar 46. Before connecting the pipe 54 to the collar the installer places a sealant bead around the pipe and slides it in place so that the connection between the connecting portion 57 and the collar 46 is provided with a high temperature sealant. Once the parts lock or are otherwise seated, set screws or self-tapping screws can be passed through the collar 46 and the junction end 57, to securely hold the inner flue exhaust pipe in position so it opens only to the combustion chamber and not to the duct portions for fresh air intake. The collar 46 passes through the upper duct section.

During this operation, the module 32 is removed from the housing 12, so the only parts that has to be manipulated inside the fireplace chamber is the module 32, which is substantially lighter and smaller than the fireplace housing, so it is easy to manipulate.

The outer fresh air duct tube 54 then is placed onto the collar 42 and suitable sealed with a sealant, held in with one or more self-tapping screws.

Before placing the tube 54 in position, and sliding the connector 55 in place, additional sealant is placed around the joint between the collar 46 and the exhaust flue tube 56. This can be done by pulling the tube 56 downwardly to clear the end portion 55 of the duct tube 54, which also can be pushed upwardly since it is a flexible and expanding type tube or pipe. When the joint or junction for carrying exhaust gases is sealed securely, then the exterior pipe 54 is put into place and held on the collar 40 and sealed properly.

Figure 7:
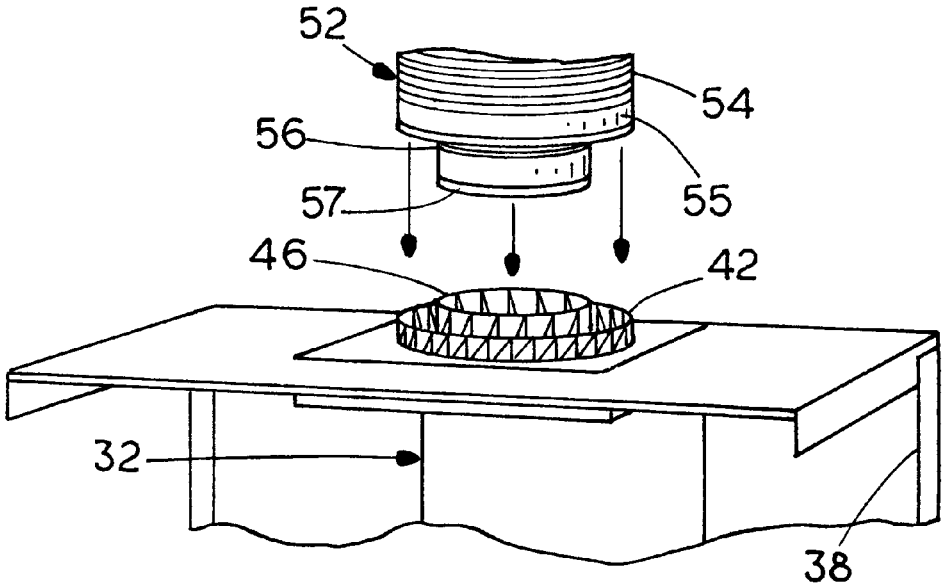
FIG. 7 is a schematic perspective view of the fresh air intake duct module being manipulated for attachment to the fresh air intake pipe and flue pipe used with the present invention.

The top of the module 32 is shown in FIG. 7, with the ends of the exhaust pipe and flue pipe aligning with the respective collars.

Once the connection has been made between the air intake pipe 54 and the flue pipe 56, with the respective collars 42 and 46, the module 32 is resting in the interior chamber 90 of the fireplace. A gasket shown schematically at 110, in FIG. 2 can be placed around the opening 26 so that the bottom wall 50 of the horizontal fresh air duct section will rest on the gasket. This is shown in FIG. 8 as well. The outlet opening 34 also has a gasket 112 surrounding it. When the module 32 is mated with the housing 12, the intake and exhaust openings will align when the wall 39 of the vertical plenum section 37 is adjacent to the rear wall 28 of the fireplace insert housing, and the top wall 50 of the horizontal section 44 is resting on the gasket 110.

This can be done quite easily, and from the front opening into the fireplace insert burner chamber 14. The installer can run self-tapping screws through openings shown at 111 in the wall 24 and also in the gasket, and tighten down the bottom wall 50 of the horizontal section of the fresh air plenum against the gasket and wall 24. This provides adequate sealing in a simple manner.

The heat exchanger for circulating room air around the outer walls of the chamber 14 is formed in part by the opening 90 of the conventional fireplace, the fan will direct air up along the back wall of the housing 12 on opposite sides of the fresh air duct, across the top of the housing and then cause the heated air to exit at the top through a grill 114 shown in FIG. 8.

Thus, the modular assembly of a fresh air intake duct system with a gas fireplace housing provides for a unique construction of an insert that can be easily inserted into existing solid fuel burning fireplaces.

Figure 9:
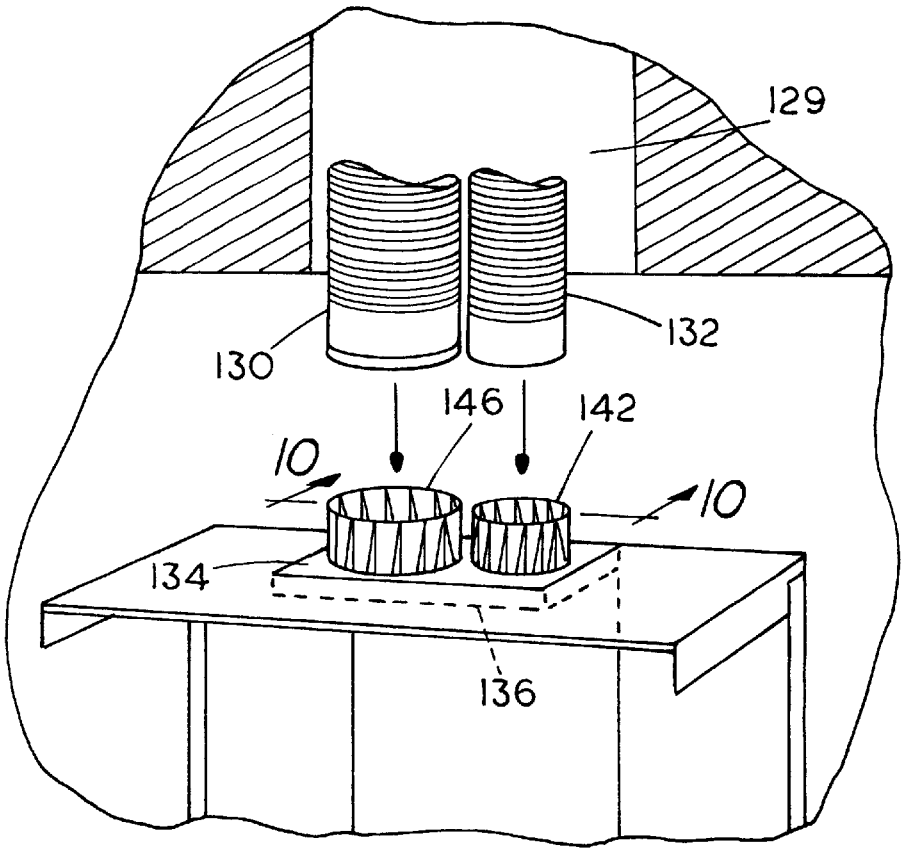
FIG. 9 is a schematic perspective view of an installation where fresh air intake and exhaust tubes may be placed side by side.
Figure 10:
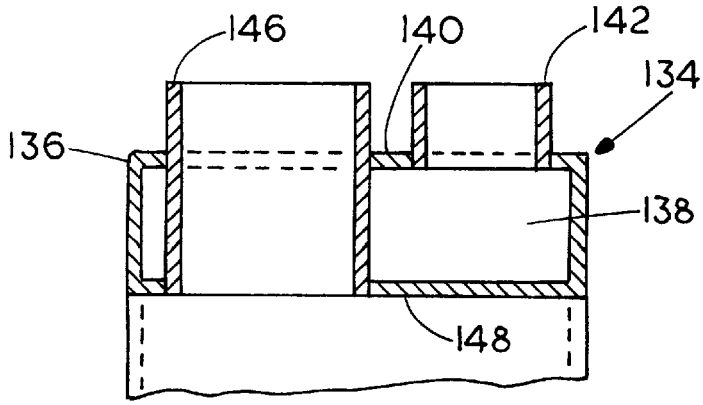
FIG. 10 is a sectional view taken on line 10—10 in FIG. 9.

When masonry chimneys are provided, they are quite large in size, and optionally a side by side arrangement for the flue exhaust pipe and the air intake pipe can be made. Where the chimney 129 is large enough, as shown in FIGS. 9 and 10, a four inch or larger exhaust pipe 130, which is also a flexible pipe, and a three inch or so combustion air intake flexible pipe 132 can be provided to come through the existing chimney in a manner previously explained. The air intake duct module is illustrated at 134. It is essentially constructed as previously explained, but as shown in FIG. 10, the horizontal duct section 136 has an interior duct or passageway 138 defined by a top wall 140 that is provided with two openings, and two attachment collars. A fresh air intake attachment collar 142 opens to the passageway 138, and passes only through the top wall 140. Collar 142 is of size to receive the pipe or tube 132 so it can be secured in place with the appropriate sealing and securing members.

A sleeve 146 forms an exhaust pipe collar that passes through the top wall 140 of the horizontal duct portion 136 and opens through the bottom wall 148. The collar 146 is sealed relative these walls so that the bottom opening of the collar 146 opens directly into the combustion chamber of the gas fireplace insert. The flexible exhaust pipe 130 then can be attached to the collar 146 in a suitable manner so that it is tightly sealed to prevent leakage of exhaust gases.

The shroud that is shown in FIG. 9 is the same as that shown in the previous form of the invention and the fresh air and exhaust connection module can be attached in the same manner using gaskets as explained.

Thus, both concentric pipes and side by side or colinear pipes can be utilized in installation of a gas fireplace insert into an existing fireplace opening, dependent on the size of the existing chimney.

The first form of the invention is used largely where a metal diameter exhaust flue pipe is provided in the existing solid fuel fireplace. The colinear construction of FIGS. 9 and 10 is used primarily where there are large masonry chimneys.

The flexible tubes used are the type that can be compressed in length and then pulled to elongate them.

Although the present invention has been described with reference to preferred embodiments, workers skilled in the art will recognize that changes may be made in form and detail without departing from the spirit and scope of the invention.

What is claimed is:

1. A module gas fireplace insert for inserting into an existing solid fuel burning fireplace having an existing solid fuel burning fireplace chimney comprising a housing for forming a combustion chamber having walls including a rear wall and an upper wall, the rear wall having an air inlet opening therein and the upper wall having an exhaust outlet opening therein;

an intake air duct module, the duct module including a first duct section extending along the rear wall and a unitary second duct section extending along the upper wall, the first and second sections of the duct module having an internal duct passageway, an air outlet opening in the first section of the duct module that aligns the air inlet opening in the rear wall of the housing, and including a connecting sleeve fixedly mounted on a top wall of the second duct section for a fresh air intake open to the duct passageway, and an exhaust connector sleeve fixedly mounted on the second duct section of the duct module and passing through the duct passageway, the exhaust connector sleeve aligning with the exhaust outlet opening in the upper wall of the housing, the duct module, including the connecting sleeve and the exhaust connector sleeve, being removable as a unit from the housing, connecting to mounted to extend through the existing solid fuel fireplace chimney into the existing solid fuel fireplace and connected to the connection sleeve and exhaust connector sleeve, respectively, with the duct module removed from the housing, and the duct module and connected fresh air and exhaust pipes being attached to the housing while the housing is in the solid fuel burning fireplace.

2. The fireplace insert of claim 1 and a gasket between the duct module and the upper housing wall to surround the exhaust opening in the upper wall of the housing.

3. The fireplace insert of claim 2 and a gasket between the duct module and the rear wall of the housing for sealing around the intake air opening.

4. The fireplace insert of claim 1, wherein the duct module includes wall portions forming a heated air passageway in combination with the housing when installed thereon.

5. The fireplace insert of claim 1 including a termination assembly for supporting both the fresh air and duct pipes on an upper end portion of existing solid fuel fireplace chimney including a flange supportable on an upper edge of the chimney, and the termination assembly having air intake and heated exhaust gas passageways communicating with the atmosphere.

6. A method of installing a gas fireplace insert in an existing solid fuel burning fireplace opening having an existing solid fuel burning fireplace chimney, wherein the insert has at least two modules including an intake air duct module and a burner housing module, including providing an exhaust opening from the burner housing in a first wall and a fresh air intake opening into the combustion chamber in a second wall and separated from the exhaust opening, securing two separate pipes to the existing chimney at an upper end of the existing and extending the separate pipes into the existing fireplace opening, placing the intake air duct module in the existing fireplace opening when separated from the housing, connecting the pipes to separate couplers mounted on the intake air duct module while the intake air duct module is separated from the burner housing module and inside the existing fireplace opening, installing the burner housing module into the existing fireplace opening, positioning the air intake duct module on the burner housing module inside the existing fireplace opening with one coupler aligning with and sealed relative to a perimeter of the exhaust opening in the burner housing module, the intake air duct module having an opening positioned to align with the intake air opening in the housing, and securing the intake air duct module to the burner housing module while inside the existing fireplace opening.

7. The method of claim 6, including the step of providing a gasket surrounding the intake air opening and the opening in the air intake air duct.

8. The method of claim 6 including the step of supporting the separate pipes on a termination assembly at first ends, and wherein the securing step comprises supporting the termination assembly on the top of an existing chimney.

9. The method of claim 6 including the step of applying a sealant between the pipes and the couplers when connecting the pipes to the couplers.

10. The method of claim 6 including placing the pipes concentrically one inside the other.

11. The method of claim 6 including the step of placing the pipes side by side.

12. The method of claim 6 including the step of providing flexible pipes which are linearly extendable to increase their lengths.

* * * * *